US006126491A

United States Patent [19]

McCarthy

[11] Patent Number: 6,126,491

[45] Date of Patent: Oct. 3, 2000

[54] ELECTRICAL CONNECTOR APPARATUS AND METHOD

[75] Inventor: Dale C. McCarthy, Pensacola, Fla.

[73] Assignee: Centerpin Technology, Inc., Gulf Breeze, Fla.

[21] Appl. No.: 09/289,905

[22] Filed: Apr. 13, 1999

Related U.S. Application Data

[63] Continuation-in-part of application No. 08/999,356, Dec. 29, 1994, Pat. No. 5,934,943, which is a continuation-in-part of application No. 08/645,514, May 14, 1996, Pat. No. 5,704,814.

[51] Int. Cl.[7] ..... H01R 13/502

[52] U.S. Cl. ..... 439/695; 439/428

[58] Field of Search ..... 439/427, 428, 439/431, 461, 695

[56] References Cited

U.S. PATENT DOCUMENTS

| | | |
|---|---|---|
| 916,313 | 3/1909 | Herrington . |
| 3,097,035 | 7/1963 | Despard . |
| 3,633,147 | 1/1972 | Polidori . |
| 3,744,007 | 7/1973 | Horak . |
| 3,860,320 | 1/1975 | Danner . |
| 4,013,333 | 3/1977 | Chang . |
| 4,091,233 | 5/1978 | Berman . |
| 4,374,458 | 2/1983 | Komada et al. . |
| 4,561,179 | 12/1985 | Brush, Jr. et al. . |
| 4,739,126 | 4/1988 | Gutter et al. . |
| 4,759,722 | 7/1988 | Song . |
| 4,786,760 | 11/1988 | Friedhelm . |
| 5,066,248 | 11/1991 | Gaver, Jr. et al. . |
| 5,362,251 | 11/1994 | Bielak . |
| 5,403,201 | 4/1995 | McCarthy . |
| 5,607,320 | 3/1997 | Wright . |
| 5,704,814 | 1/1998 | McCarthy . |
| 5,934,943 | 8/1999 | McCarthy ..... 439/695 |

*Primary Examiner*—Khiem Nguyen
*Attorney, Agent, or Firm*—Saliwanchik, Lloyd & Saliwanchik

[57] ABSTRACT

An electrical connector and method for coupling an electrical conductor thereto has a conductor housing having at least one bore therein and an electrical conductive prong mounted in the housing bore. An electrical conductor gripping collar is positioned in each conductor housing bore with gripping fingers extending from the housing bore. A collar driving member or collar ring has an opening therein to receive an insulated electric conductor which extends therethrough, and through the gripping collar into the housing bore end onto the electrical conductive prong and to engage the extended and of the gripping collar. The collar driving member is used to push the gripping collar further into the housing bore to force the gripping fingers of the gripping collar onto the electrical conductor's insulation. The collar driving member is then fastened to the connector housing to couple the electrical conductor to the electrical connector. The housing can have a plurality of bores therein each having a gripping collar attached thereto driven by a single collar driving member having a plurality of openings therethrough for a plurality of electrical conductors.

33 Claims, 4 Drawing Sheets

ELECTRICAL CONNECTOR APPARATUS AND METHOD

This application is a continuation-in-part of my prior U.S. patent application for an electrical connector, Ser. No. 08/999,356, filed Dec. 29, 1997, now U.S. Pat. No. 5,934,943 which is a continuation-in-part of my prior U.S. patent application Ser. No. 08/645,514, dated May 14, 1996, now U.S. Pat. No. 5,704,814, dated Jan. 6, 1998.

BACKGROUND OF THE INVENTION

The present invention relates to an electrical connector apparatus and method and especially to an electrical connector for coupling to an insulated electrical conductor without stripping the end of the insulated electrical conductor.

In the past, a wide variety of electrical wire connectors have been provided for connecting to wire ends. In a typical connector, the end of the wire is stripped of insulation and the bare wire is inserted into a connector where it can be soldered or clamped to or otherwise attached to the connector. It is also common to coat or tin the ends of an electrical conductor, with the insulation stripped from the end thereof, with a thin coat of solder. A wide variety of connectors have also been provided which removably hold a wire end to a connector.

My prior U.S. Pat. No. 5,704,814 for an Electrical Connector provides an electrical connector for coupling to an insulated electrical conductor which includes an insulated housing having threaded bores with a tapered portion therein. An electrical conductive prong extends into the housing bore for receiving an insulated electrical conductor thereon. The compression collar is threadedly attached in the bore and has a bore extending axially therethrough for insertion of a wire into the housing bore and onto a pointed prong extending into the bore. The compression collar compresses into the tapered portion of the bore to grip the electrical conductor extending therethrough.

Prior wire connectors can be seen in the following U.S. Patents. The Chang patent, U.S. Pat. No. 4,013,333, is for a wire connector having two concentric sockets adapted to be assembled one into the other. The inner socket has a conductive needle mounted therein for sliding a wire end into each end of the connector. In the Danner, U.S. Pat. No. 3,860,320, a cathode cable assembly is connected to a ball-like cathode member by stripping the end portion of the cable and inserting the end portion into a sleeve which is pressed into an undersized tapered socket and which has a pointed pin therein. The Friedhelm, U.S. Pat. No. 4,786,760, has a cable connector for a piezoelectric cable having an insulated cable end which is inserted into a sleeve. In the Berman, U.S. Pat. No. 4,091,233, an electrical connector and a method of connecting an electrical cable to the connector is provided for connecting one or more insulated electrical cords or cables together. The insulated cable ends can be inserted into the receptacles on either end and onto a prong of electrically conductive material so that the prong is an electrical contact with the wire of an insulated cord end. A container of adhesive material on the end of the receptacle is released from the container to create a physical bond between the cord and the connector to hold the cord within the connector. In my prior U.S. Pat. No. 5,403,201 an electrical connector is coupled to an insulated electrical conductor without stripping the end of the insulated conductor. The insulated wire is held with a spring clamp which allows the wire to be released.

The Komada U.S. Pat. No. 4,374,458 is for a method of connecting a co-axial cable to a connector having a plurality of connections. The Herrington U.S. Pat. No. 916,313 is for a spark plug having a spark plug wire connector on the end thereof. The Despard U.S. Pat. No. 3,097,035 is for another electric cable connector for use between sections of flexible multi-conductor cable as used with portable electric power consuming equipment and a fixed power outlet. The Polidori U.S. Pat. No. 3,633,147 has a connector for underground utility applications.

The Gutter et al. U.S. Pat. No. 4,739,126, is for a panel mount ground termination apparatus for terminating the outer shielding conductor of an electrical cable. A cable is passed through a closure member and through a compression member and through a termination member and into the housing to compress a plurality of prongs into the cable. The Horak U.S. Pat. No. 3,744,007, is for a three-piece coaxial cable connector as is the Brush, Jr. et al. U.S. Pat. No. 4,561,179, for a method for electrical connection to the center conductor of an insulated wire. The Song U.S. Pat. No. 4,759,722 is for a plug for coaxial cables while the Gaver, Jr. et al. U.S. Pat. No. 5,066,248 is for a manually installable coaxial cable connector. The Bielak U.S. Pat. No. 5,362,251 is for a solderless coaxial connector plug while the Wright U.S. Pat. No. 5,607,320 is for a cable clamp apparatus.

The present invention is for an electrical connector and a method of coupling an insulated electrical conductor to the electrical connector by threading the electrical conductor through a fastening cap and through a collar driving member and then through an electrical conductor gripping collar and into the connector housing bore and onto an electrical conductive prong. The electrical connector allows the rapid connection of a plurality of conductors to a corresponding plurality of conductive prongs.

SUMMARY OF THE INVENTION

An electrical connector for coupling an electrical conductor thereto has a conductor housing having at least one bore therein and an electrical conductive prong mounted in the housing bore. An electrical conductor gripping collar is positioned in each conductor housing bore and has associated therewith a corresponding collar driving member. An insulated electric conductor is inserted through an electrical fastening cap, through the collar driving member and through the gripping collar into the housing bore and onto the electrical conductive prong. The collar driving member is pushed onto the gripping collar either independently or by the fastening cap to force the gripping fingers on the gripping collar onto the electrical conductor's insulation. The fastening cap is then fastened to the connector housing to secure the electrical conductor to the electrical connector.

The housing can have a plurality of bores therein each having a gripping collar attached thereto driven by a single collar driving member having a plurality of openings therethrough for a plurality of electrical conductors. A single fastening cap can push the collar driving member to drive each of the gripping collars onto one of the insulated conductors.

A method of connecting an electrical conductor to an electrical connector includes selecting an apparatus as set forth and threading one or more electrical conductors through the fastening cap collar driving member and gripping collars into the connector housing bores and onto the electrical conductive prong in each bore and then pushing the collar driving member onto each gripping collar to drive each gripping collar into the housing bore and onto an electrical conductor extending therethrough and then fastening the collar driving member to the housing.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
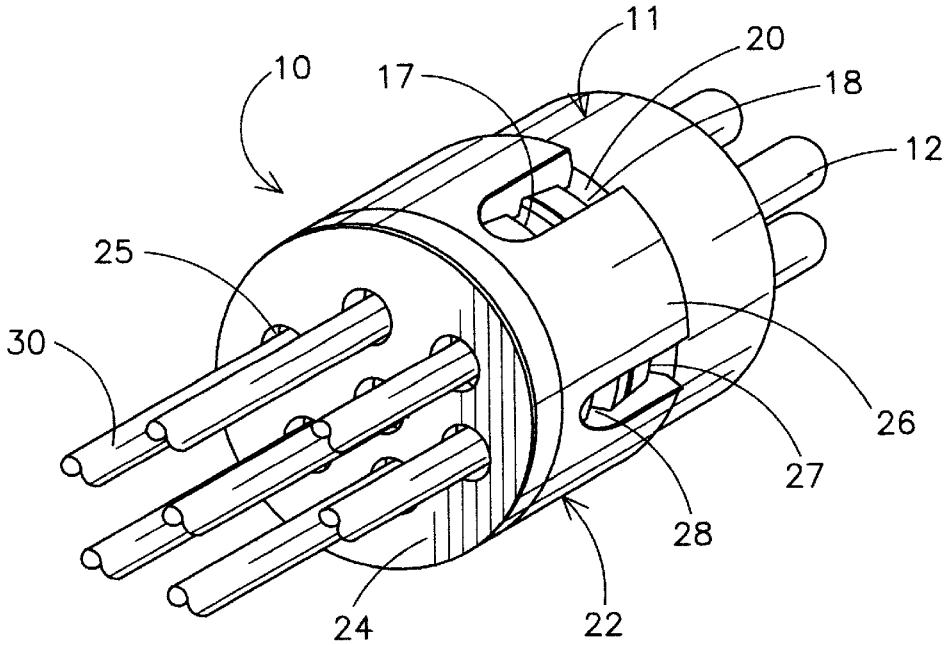
FIG. 1 is a perspective view of an electrical connector connected to a plurality of conductors in accordance with the present invention.
Figure 2:
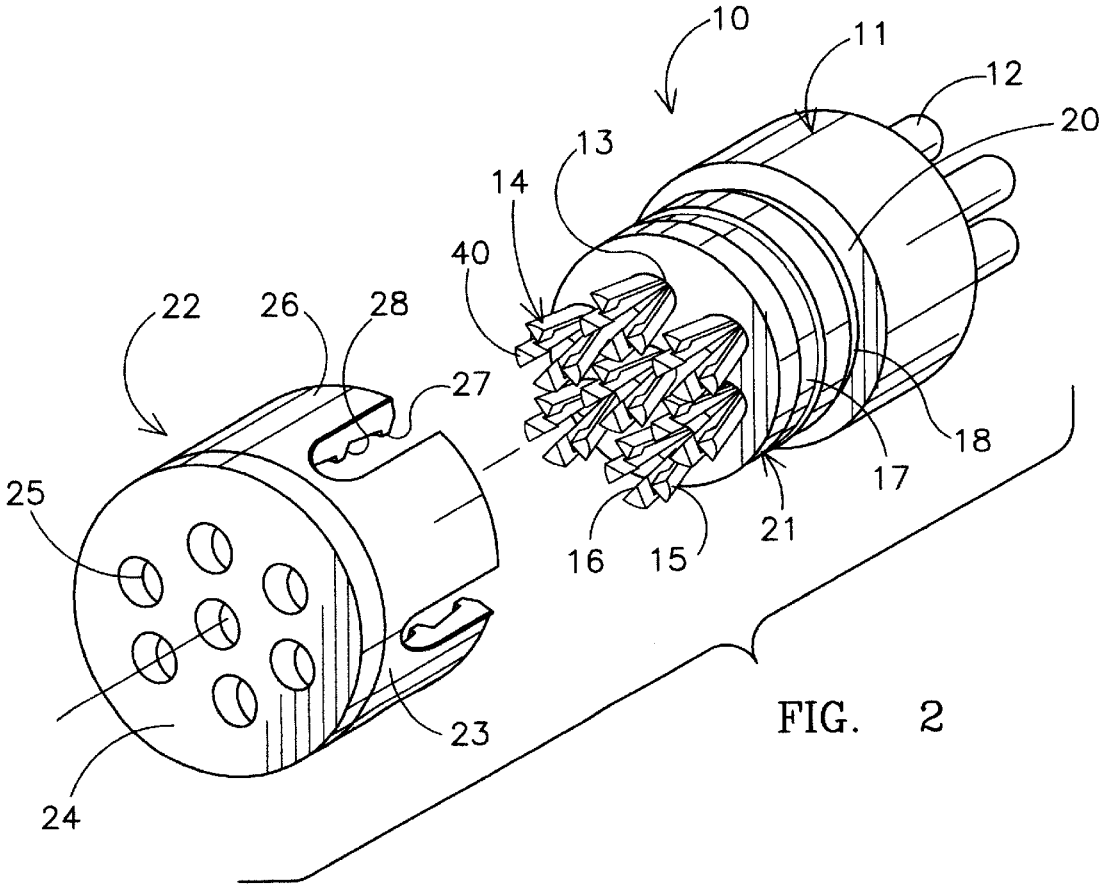
FIG. 2 is a exploded perspective view of the connector in accordance with claim 1.

Referring to the drawings and especially to FIGS. 1 through 4, an electrical connector 10 is illustrated having a housing 11 having a plurality of electrical contacts 12 extending from one end thereof. The other end of the housing has a plurality of bores 13 extending thereinto with each bore having a conducting gripping collar 14 inserted into the bore 13. Each collar 14 is split and has a plurality of gripping fingers 15 extending from one end thereof which are outwardly splayed and each gripping finger has a gripping tip 16 or edge 16. The housing 11 may have a first annular groove 17 and needs a second annular groove 18 therearound along with an edge 20 defining the reduced attaching portion 21 of the housing 11. A combined fastening cap and collar pushing member 22 has a fastening cap or side wall portion 23 and a collar pushing member or closure ring 24 with a plurality of apertures 25 therethrough. Each of the apertures 25 is positioned to align with one of the housing bores 13. The cap portion 23 is divided into a plurality of fastening arms 26 each having at least a first fastening snap ledge or ring 27 and may have a second snap ledge or ring 28 thereon. The connector 10, as seen in FIG. 1, has a plurality of insulated electrical conductors 30 attached thereto and extending through the collar pushing portion 24 apertures 25, although the embodiment may be scaled except for a single insulated electrical conductor.

Figure 3:
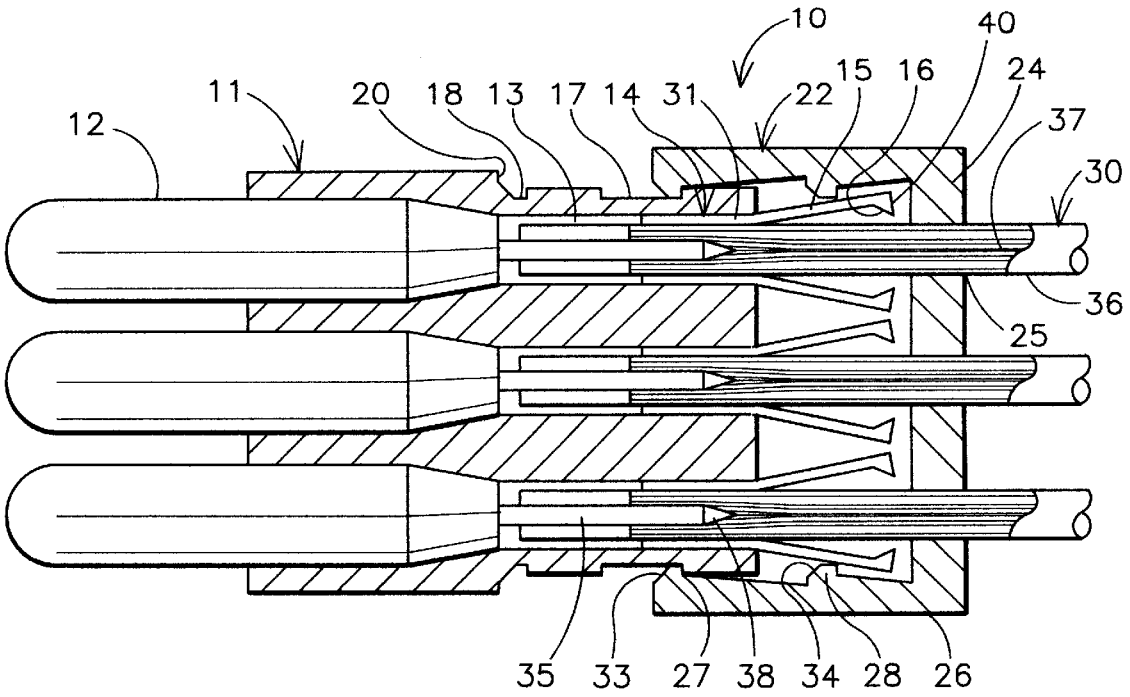
FIG. 3 is a sectional view taken through the electrical connector of FIGS. 1 and 2 with the electrical conductors not yet connected.
Figure 4:
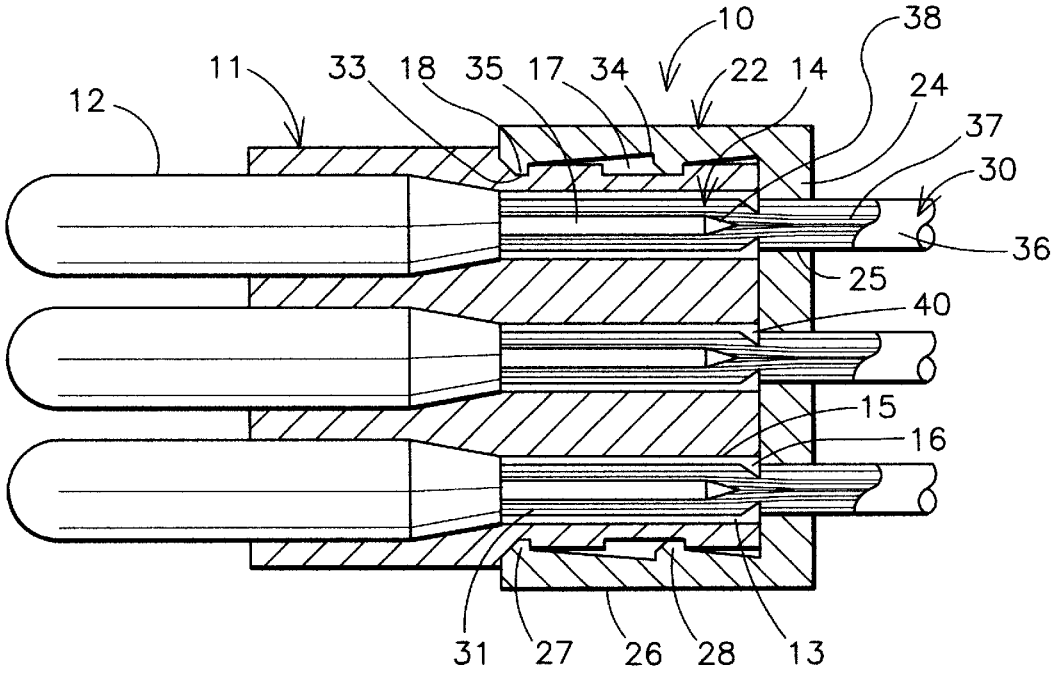
FIG. 4 is a sectional view of the electrical connector of FIGS. 1 and 2 having the conductor attached to the connector.

In operation, the electrical connector 10 will have the conductor gripping collars 14 barrel portion 31 inserted into each bore 13 with the cap 22 being attached to the housing 11 by the arms 26 first fastening snap ledge 27 pushed into the first annular groove 17, as shown in FIG. 3. The tip 27 has an angled surface 33 while the fastening snap ledge 28 has an angled surface 34 thereon. In the position as shown in FIG. 3, the insulated electrical conductors 30 have each been inserted through the apertures 25 through a collar 14 into the bore 13 and impaled onto electrical conductive contact prongs or pins 35. Each electrical conductor 30 has an outer insulation 36 surrounding a conductor 37. The insulation has not been stripped on the conductors 30 since they are being pushed onto the prongs 35. Each prong 35 having a pointed tip 38. In FIG. 3 it can be seen that the collars 14 gripping fingers 15 are splayed so that the conductor 30 can be inserted therethrough. Once the conductors are all inserted into the electrical connector, the fastening cap 26 along with the collar pushing portion 24 is forced against the ends 40 of the gripping fingers of the conductor gripping collars 14. Thus, the gripping collars 14 are each driven into their respective bores 13 forcing the fingers 15 to be driven onto each conductor 30 with the gripping tips 16 being driven into the insulation 36 of the electrical conductor 30. The tips 16 can be driven all the way through the insulation to make contact with the electrical conductor 37 or can be driven to compress onto the insulation 36. As the fastening cap 22 is forced onto the housing 11, the fastening snap ledge 27 is pushed from the groove 17 into the groove 18 while the fastening snap ledge 27 is pushed into the groove 17 to lock the cap 22 fastening portion to the housing 11, as seen in FIG. 4.

The electrical connector, as illustrated in FIGS. 1–4, advantageously allows the electrical connector to be set up as illustrated in FIG. 3 ready for a plurality of conductors 30 to be inserted into the connector for attachment thereto. The cap and collar pushing member 22 can then be driven from the first position, shown in FIG. 3, to the second position, shown in FIG. 4, to attach all of the conductors 30 simultaneously with electrical contact with the prongs 35 and, if desired, with the gripping teeth 16.

Figure 5:
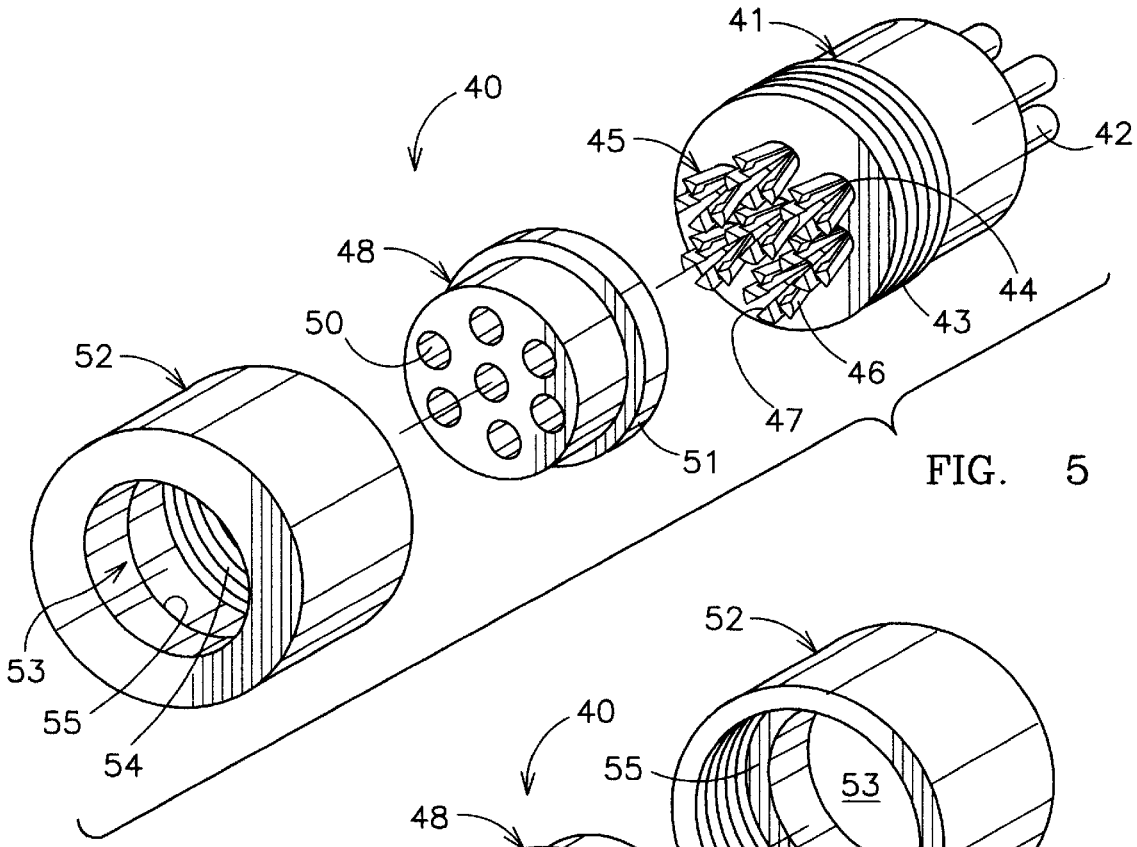
FIG. 5 is an exploded perspective view of a second embodiment of a connector in accordance with the present invention.
Figure 6:
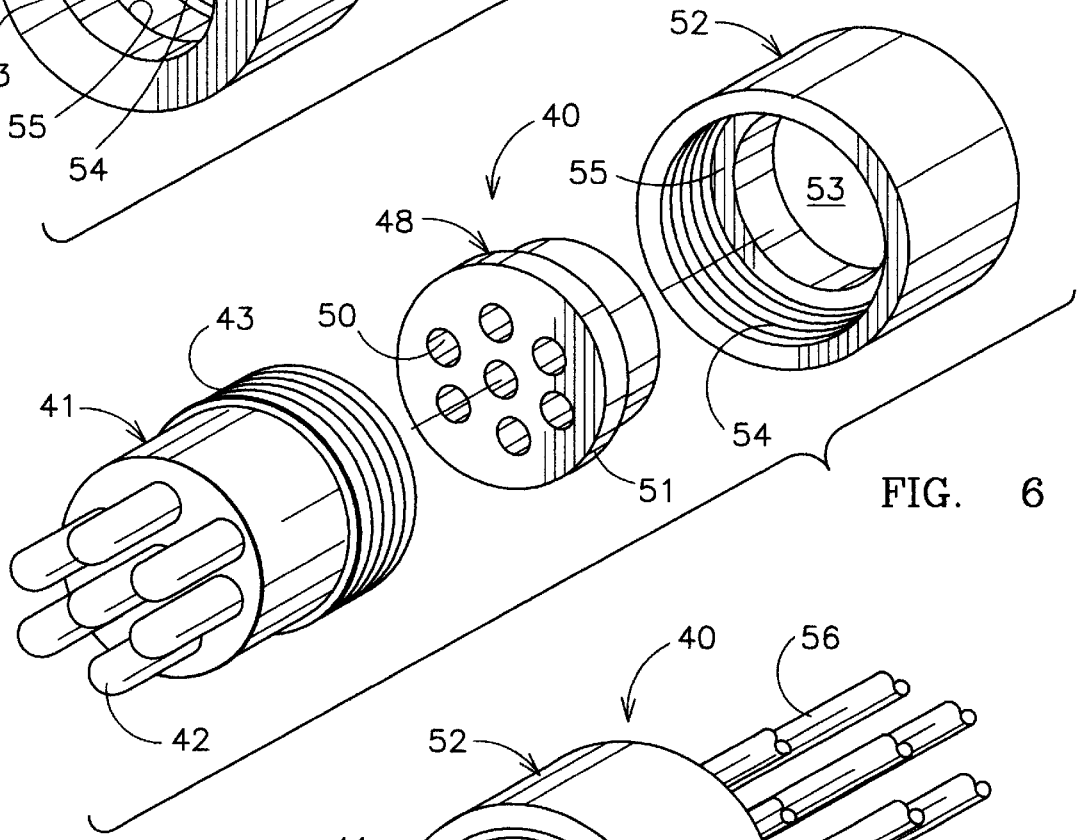
FIG. 6 is an exploded perspective view of the connector of FIG. 5 from the opposite end.
Figure 7:
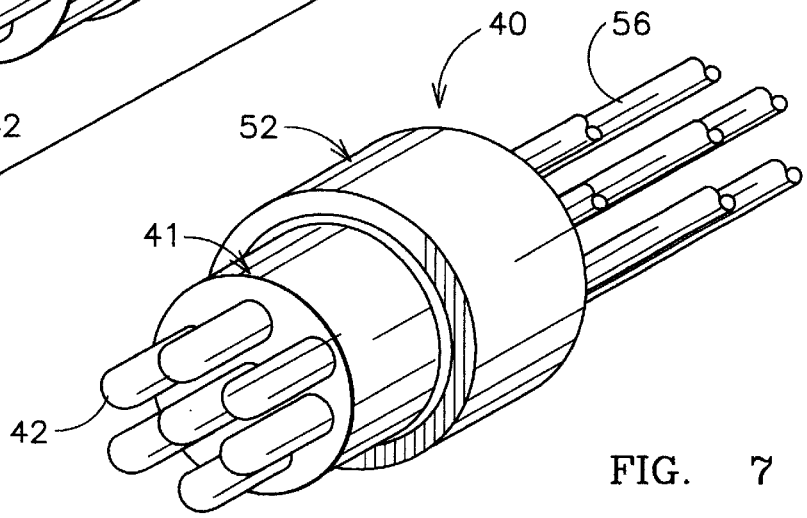
FIG. 7 is a perspective view of the connector of FIGS. 5 and 6 having a plurality of conductors attached thereto.

Turning now to FIGS. 5 through 7, an electrical connector 40 is illustrated which operates in the manner of the connector of FIGS. 1 through 4 except with a threaded attachment on the cap for attaching all of the conductors to the connector. The electrical connector 40 has a housing 41 having a plurality of electrical contacts 42 extending from one end thereof and has an externally threaded portion 43 therearound. The housing has a plurality of bores 44 extending thereinto each having a conductor gripping collar 45 positioned therein which collar is the same as that illustrated in FIGS. 2, 3 and 4 and each collar having a plurality of fingers 46 with gripping tips 47. In this embodiment, the collar pushing member 48 is a separate component having a plurality of bores 50 extending therethrough and aligned with the bores 44 of the housing 41. The collar pushing member 48 has an annular flange 51 extending around one end thereof. The fastening cap, or side wall, 52 has an open passageway 53 therethrough with a plurality of internal threads 54 at one end thereof and an internal ledge 55 located thereinside sized to fit over the collar pushing member, or closure ring, 48 with the flange 51 being engaged by the ledge 55. The fastening cap 52 is threaded onto the threads 43 of the housing 41 over the collar pushing member 48. The aperture in the collar pushing member, or closure ring, 48 are sized for a conductor 56 to past through but two small for the gripping fingers 46 of the conductor gripping collars 45 to fit into. The fastening cap 52 can be partially threaded onto the housing 41 over the collar pushing member 48 which is positioned against each of the conductor gripping collars 45. The conductors 56 can then be slid through the apertures 50 of the collar pushing member 48 and through the conductor gripping collars 45 into the bores 44 which may have the prong 35 of FIGS. 1 through 4 extending into each bore. Once the conductors are inserted into the connector 40, the collar pushing member 48 is pushed against the ends of each conductor either independently or by threading gripping collar 45 to drive the fingers 46 into each conductor to lock the conductors 56 to the electrical connector 40 without having to strip the ends of the conductors 56 and without having to connect each separate conductor to the electrical connector. The fastening cap 52 can be tightened onto the housing by hand or with ordinary tools, such as a pair of pliers.

Figure 8:
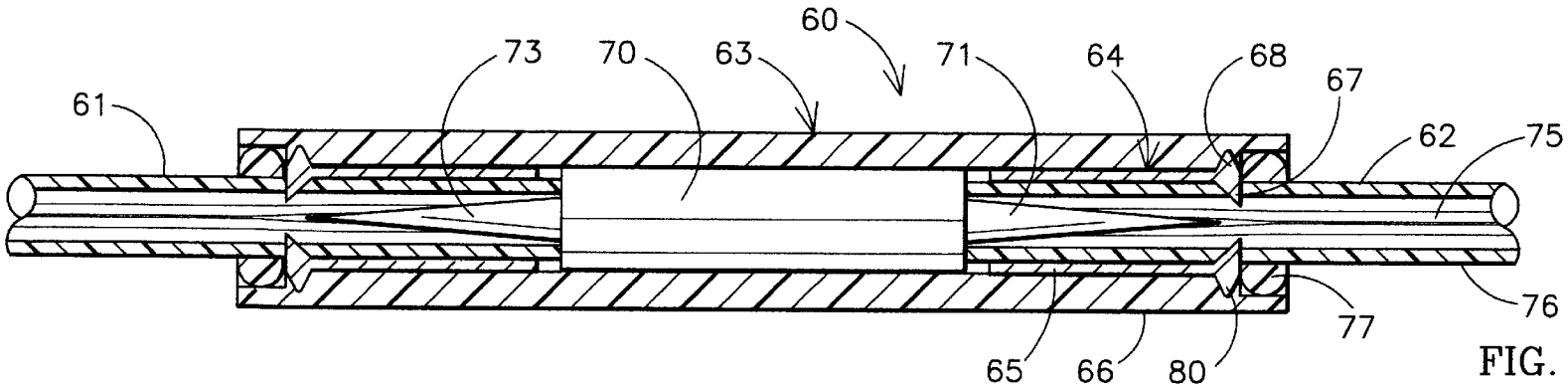
FIG. 8 is a sectional view of another embodiment of an electrical connector in accordance with the present invention.
Figure 9:
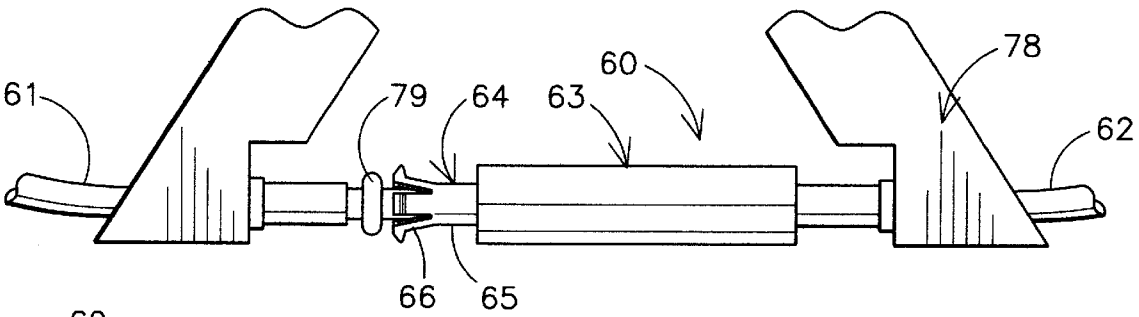
FIG. 9 is a side elevation of the electrical connector of FIG. 8 and the process of having electrical conductors attached thereto.
Figure 10:
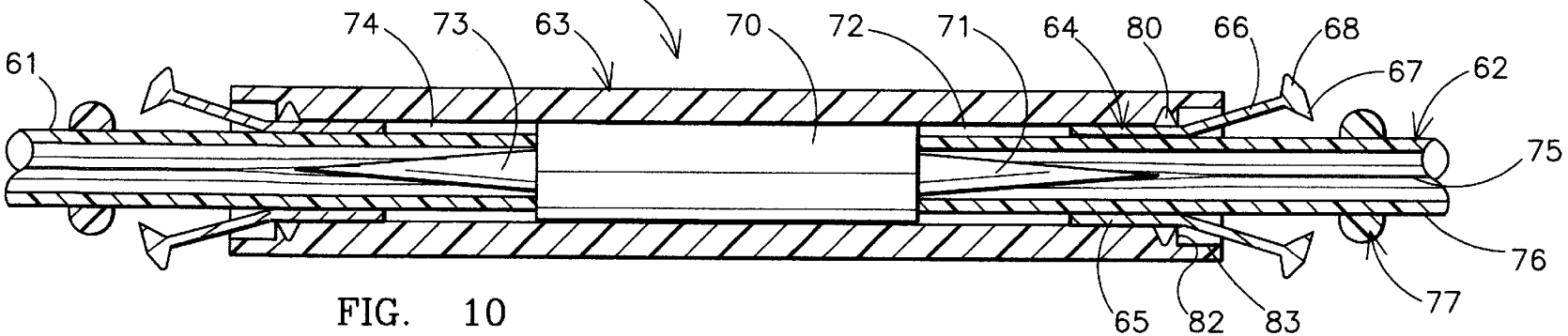
FIG. 10 is a sectional view of the electrical connector of FIGS. 8 and 9 having a pair of electrical conductors being attached thereto.

Turning now to FIGS. 8 through 10, another embodiment 60 of an electrical connector in accordance with the present invention is illustrated having a connector for two conductors 61 and 62. Connector 60 has a connector body 63 having a collar 64 inserted in each end. Each collar has a tubular portion 65 with a plurality of fingers 66 which have also been split and splayed similar to the conductor gripping collars 14 of FIG. 2 or 45 of FIG. 5. Each collar finger 66, however, has a gripping tip or edge 67 and may have a locking edge 68 on the tip of each finger 66. The connector housing 63 can have a conductive center portion 70 with a prong or pin 71 extending into a bore 72 on one end and a prong or pin 73 extending into a bore 74 on the other end thereof. Each conductor 61 and 62 has a central conductive portion 75 with an outer insulation 76.

In operation, the collar pushing member or collar ring 77 is placed on each conductor 61 and 62, as seen in FIG. 10, and then the conductor inserted through the collar 64 into the bore 72 and impaled onto the electrical conductive prong 71 to make electrical contact between the electrical conductor 75 and the prongs 71 and 73. The collar pushing member 77, which can be made of a resilient material, is then driven from one or both ends with a pliers-like tool 78, as illustrated in FIG. 9. As the collar pushing member 77 is driven on each conductor 61 and 62, it drives against the ends of the collars 64 to drive the collars further into the bore 72 forcing the gripping tips 67 into the conductors 61 and 62 to grip the conductors, as shown in FIG. 8. Alternatively, the fingers 66 and gripping tips 67 may be manually squeezed onto the conductors before the pushing member 7 is driven against, if included, the collars 64. As the collars 64 are driven into the bore 72, the fastening tip 68, if included, is driven into an annular groove 80, as shown in FIG. 8, to thereby lock each collar in place within the housing 63. The angled tips 81 allow the fastening tips to slide into the grooves 80 over the groove defining ledges 82. Simultaneously, the collar pushing member 77 is driven into an enlarged bore portion 83 to provide a locking seal between the collar finger 66, the conductor 62, and the connector body 63, as seen in FIG. 8.

It should be clear at this time, that an electrical connector and a method of attaching an electrical conductor to an electrical connector have been provided which allow multiple conductors to be attached to an electrical connector in a simplified and rapid manner without having to strip the conductors. However, it should also be clear that the present invention is not be limited to the forms shown which are to be considered illustrative rather than restrictive.

I claim:

1. An electrical connector comprising:

a housing having a bore therein and a conductive pin centered in said bore;

an electrical conductor gripping collar supported in said bore with one end extending outwardly from the bore and sized to receive an electrical conductor therethrough;

a closure ring having a central aperture sized for receiving an electrical conductor and a surface for engaging the outwardly extending end of said electrical conductor gripping collar; and means for securing said closure ring to said housing;

whereby with an electrical conductor inserted through the central aperture of said closure ring and through said electrical conductor gripping collar and impaled onto said pin in said housing, forcible movement of said closure ring along the electrical conductor forces said electrical conductor griping collar further into said bore and into gripping relation with the surface of the electrical conductor.

2. The electrical connector set forth in claim 1 wherein the extending end of said electrical conductor gripping collar is split and splayed for engaging the surface of said closure ring and wherein the splayed ends of said electrical conductor gripping collar has inwardly extending edges on the ends thereof for engaging the surface of an electrical conductor positioned therein.

3. The electrical connector set forth in claim 2 wherein the securing means is a second bore in the bore of said housing sized to produce an interference fit with the outer surface of said closure ring, whereby with forcible movement of said closure ring along an electrical conductor, said electrical conductor gripping collar is further recessed into the bore of said housing and said closure ring is seated in said second bore.

4. The electrical conductor set forth in claim 2 wherein the securing means is a cylindrical side wall that embraces said closure ring and fits over the outer surface of said housing and wherein the inner surface of said side wall and the outer surface of said housing are cooperatively threaded, whereby with said side wall initially threaded onto said housing and with an electrical conductor inserted through the central aperture of said closure ring and through said electrical conductor gripping collar and impaled onto said pin in said housing, further threaded movement of said side wall along the outer surface of said housing moves said closure ring against said electrical conductor gripping collar and forces said electrical conductor gripping collar into said bore and into gripping relation with the surface of the electrical conductor.

5. The electrical conductor set forth in claim 4 wherein said closure ring and said side wall are separate.

6. The electrical conductor set forth in claim 2 wherein the securing means is a cylindrical side wall that embraces said closure ring and fits over the outer surface of said housing and wherein the inner surface of said side wall includes a protruding ring and the outer surface of said housing includes a groove complimenting said protruding ring whereby with said side wall initially positioned onto the outer wall of said housing and with an electrical conductor inserted through the central aperture of said closure ring and through said electrical conductor gripping collar and impaled onto said pin in said housing, further forcible movement of said side wall along the outer surface of said housing moves said closure ring against said electrical conductor gripping collar and forces said electrical conductor gripping collar into said bore and into gripping relation with the surface of the electrical conductor and forces the protruding ring of said side wall into seating position with the groove in the outer surface of said housing.

7. The electrical conductor set forth in claim 6 wherein said closure ring and said side wall are integral and said closure ring forms a back wall to said side wall.

8. An electrical connector comprising:

a housing having a plurality of bores therein and a corresponding plurality of conductive pins centered in each of said bores;

a corresponding plurality of electrical conductor gripping collars supported in each of said bores with one end extending outwardly from the bore and sized to receive an electrical conductor therethrough;

a closure ring having a corresponding plurality of apertures aligned with said bores and sized for receiving an electrical conductor and having a flat surface for engaging the outwardly extending ends of said electrical conductor gripping collars; and means for securing said closure ring to said housing;

whereby, with electrical conductors inserted through the apertures of said closure ring and through said electrical conductor gripping collars and impaled onto said pins in said housing, forcible movement of said closure ring along the electrical conductors forces said electrical conductor gripping collars further in said bores and into gripping relation with the surface of the corresponding electrical conductor.

9. The electrical connector set forth in claim 8 wherein the extending end of each of said electrical conductor gripping collars is split and splayed for engaging the flat surface of said closure ring and wherein the splayed ends of each of said electrical conductor gripping collars has inwardly extending edges on the ends thereof for engaging the surface of an electrical conductor positioned therein.

10. The electrical connector set forth in claim 8 wherein the securing means is a cylindrical side wall that embraces said closure ring and fits over the outer surface of said housing and wherein the inner surface of said side wall and the outer surface of said housing are cooperatively threaded, whereby with said side wall initially threaded onto said housing and with electrical conductors inserted through the apertures of said closure ring and through said electrical conductor gripping collars and impaled onto said pins in said housing, further threaded movement of said side wall along the outer surface of said housing moves said closure ring against said electrical conductor gripping collars and forces said electrical conductor gripping collars into said bore and into gripping relation with the surface of the associated electrical conductors.

11. The electrical conductor as set forth in claim 10 wherein said closure ring and said side wall are separate.

12. The electrical conductor set forth in claim 8 wherein the securing means is a cylindrical side wall that embraces said closure ring and fits over the outer surface of said housing and wherein the inner surface of said side wall includes a protruding ring and the outer surface of said housing includes a groove complimenting said protruding ring whereby with said side wall initially positioned onto the outer surface of said housing and with electrical conductors inserted through the apertures of said closure ring and through said electrical conductor griping collars and impaled onto said pins in said housing, further forcible movement of said side wall along the outer surface of said housing moves said closure ring against said electrical conductor gripping collars and forces said electrical conductor gripping collars into said bores and into gripping relation with the surface of the associate electrical conductors and forces the protruding ring of said side wall into seating position with the groove in the outer surface of said housing.

13. The electrical conductor set forth in claim 12 wherein said closure ring and said side wall are integral and said closure ring forms a back wall to said side wall.

14. A method of connecting an electrical conductor to an electrical connector comprising the steps of:

selecting a connector housing having a bore therein and having an electrical conductive prong mounted in said housing bore;

selecting an electrical conductor gripping collar having a plurality of gripping fingers extending therefrom;

attaching said selected gripping collar partially in said housing bore with said plurality of gripping fingers extending from said housing;

selecting a collar driving member having an aperture therethrough sized for threading an electrical conductor therethrough and for blocking the passage of said electrical conductor gripping collar therethrough;

threading an electrical conductor through said collar driving member aperture and through said electrical conductor gripping collar and into said housing bore and onto said electrically conductive prong; and driving said collar driving member against said electrical conductor gripping collar to drive said gripping collar into the bore of said connector housing and the gripping fingers thereof onto said electrical conductor.

15. The method of connecting an electrical conductor to an electrical connector as set forth in claim 14 including the further step of squeezing the gripping fingers of said gripping collar onto the electrical conductor before the step of driving said collar driving member against said electrical conductor gripping collar.

16. The method of connecting an electrical conductor to an electrical connector in accordance with claim 14 in which the step of selecting said housing includes selecting a housing having a plurality of bores therein and the step of selecting a collar driving member includes selecting a driving member having a corresponding plurality of apertures therein positioned to align with said plurality of housing bores, whereby a corresponding plurality of electrical conductor gripping collars are positioned in the plurality of bores in said housing so that a plurality of electrical conductors can be coupled to said electrical connector at the same time by moving said collar driving member against a plurality of gripping collars having a plurality of electrical conductors threaded therethrough.

17. The method of connecting an electrical conductor to an electrical connector in accordance with claim 16 in which the step of selecting an electrical conductor gripping collar includes selecting a gripping collar having a plurality of gripping fingers extending therefrom with each said gripping collar finger having a gripping edge thereon.

18. The method of connecting an electrical conductor to an electrical connector in accordance with claim 17 in which the step of selecting an electrical conductor gripping collar includes selecting a conductive gripping collar having a conductive pointed gripping edge thereon for penetrating an electrical conductor insulation coating.

19. The method of connecting an electrical conductor to an electrical connector in accordance with claim 16 including the further step of selecting a housing cap apertured for passing a plurality of conductors therethrough and for securing said collar driving member to said connector housing.

20. The method of connecting an electrical conductor to an electrical connector in accordance with claim 19 in which the step of selecting a connector housing includes selecting a connector housing having two spaced grooves formed therein to form a two position housing fastener portion and in which the step of selecting a housing cap includes selecting a housing cap having a plurality of fingers thereon, each finger having two spaced raised areas sized and positioned to snap into said two spaced grooves in said housing.

21. The method of connecting an electrical conductor to an electrical connector in accordance with claim 19 in which the step of selecting a connector housing includes selecting a connector housing having a threaded outer surface and in which the step of selecting a housing cap includes selecting a housing cap having a corresponding threaded inner surface for threadably attaching said housing cap to said housing.

22. The method of connecting an electrical conductor to an electrical connector in accordance with claim 20 including the step of selecting a threaded housing cap and threadedly attaching said threaded housing cap to said housing.

23. An electrical connector for coupling a plurality of electrical conductors thereto comprising:

a housing having a plurality of bores therein and having a two position fastener portion thereon;

a plurality of conductor gripping collars, each of said gripping collars being supported adjacent one said housing bore;

a housing cap having a plurality of apertures therein sized for threading said plurality of conductors therethrough and blocking the passage of said plurality of conductor gripping collars therethrough, said housing cap having a fastener portion thereon adapted to fit onto said housing two position fastener portion for connecting said housing cap to said housing two position fastener portion to push against said plurality of conductor gripping collars when said housing cap fastener portion is moved between positions of said housing two position fastener portion, whereby a plurality of conductors can be simultaneously connected to an electrical connector.

24. An electrical connector for coupling a plurality of electrical conductors thereto in accordance with claim 23 in which said housing has a plurality of conductive prongs, one said prong being mounted in each of said plurality of housing bores for driving each of a plurality of electrical conductors into one said conductive prong to make electrical contact between the electrical conductor and said conductive prong.

25. An electrical connector for coupling an electrical conductor thereto comprising:

a connector housing having a bore therein and having an electrical conductive prong mounted in said housing bore;

an electrical conductor gripping collar having a plurality of gripping fingers extending therefrom attached in said connector housing bore and said plurality of gripping fingers extending therefrom;

a collar driving member having an aperture therethrough sized for threading an electrical conductor therethrough while blocking the passage of said electrical conductor gripping collar therethrough;

such that the electrical conductor can be threaded through said collar driving member aperture and through said electrical conductor gripping collar and into said housing bore and onto said electrically conductive prong; and fastening means for fastening said collar driving member to said housing whereby pushing said collar driving member having an electrical conductor threaded therethrough against said electrical conductor gripping collar drives said gripping collar onto the threaded electrical conductor so that the electrical conductor is connected to said electrical connector.

26. An electrical connector for coupling an electrical conductor thereto in accordance with claim 25 in which a conductive prong is mounted in said housing bore for driving said electrical conductor thereinto for making electrical contact between said electrical conductor and said conductive prong.

27. An electrical connector for coupling an electrical conductor thereto in accordance with claim 25 in which said housing includes a plurality of bores therein and said collar driving member has a plurality of apertures therein positioned to align with said plurality of housing bores whereby a plurality of electrical conductors can be coupled to said electrical connector at the same time by moving said collar driving member against a plurality of gripping collars having a plurality of electrical conductors threaded therethrough.

28. An electrical connector for coupling an electrical conductor thereto in accordance with claim 27 in which each said electrical conductor gripping collar includes a plurality of gripping fingers extending therefrom with each said gripping collar finger having a gripping edge portion thereon.

29. An electrical connector for coupling an electrical conductor thereto in accordance with claim 28 in which each said electrical conductor gripping collar has a conductive gripping collar having a conductive pointed gripping edge portion thereon for penetrating an electrical conductor insulation coating.

30. An electrical connector for coupling an electrical conductor thereto in accordance with claim 25 in which said connector housing has two spaced grooves formed thereon to form a two position housing fastener portion.

31. An electrical connector for coupling an electrical conductor thereto in accordance with claim 30 in which said fastening means has a plurality of fingers thereon, each finger having two spaced raised areas sized positioned to snap into said two spaced grooves in said housing.

32. An electrical connector for coupling an electrical conductor thereto in accordance with claim 25 in which said fastening means has an open center portion for passing a plurality of conductors therethrough and which clamps down upon said collar driving member to attach all of said electrical conductors to said connector housing at one time.

33. An electrical connector for coupling an electrical conductor thereto in accordance with claim 32 in which said fastening means has threads thereon for treadedly attaching to said housing.

* * * * *

UNITED STATES PATENT AND TRADEMARK OFFICE

CERTIFICATE OF CORRECTION

PATENT NO. : 6,126,491

DATED : October 3, 2000

INVENTOR(S) : Dale C. McCarthy

It is certified that error appears in the above-identified patent and that said Letters Patent is hereby corrected as shown below:

Cover Page [63] Related U.S. Application Data: "Dec. 29, 1994" should read --Dec. 29, 1997--.

Cover Page, [57] Abstract, line 9: "bore end" should read --bore and--; and line 11: "extended and" should read --extended end--.

Column 10, line 55: "treadedly" should read --threadedly--.

Signed and Sealed this

First Day of May, 2001

*Attest:*

Nicholas P. Godici

NICHOLAS P. GODICI

*Attesting Officer*

*Acting Director of the United States Patent and Trademark Office*